United States Patent [19]

Sweeney

[11] Patent Number: 5,067,854

[45] Date of Patent: Nov. 26, 1991

[54] APPARATUS AND TECHNIQUE FOR INSTALLING AN ELONGATED ROD IN AN EARTH FORMATION

[75] Inventor: Gerald T. Sweeney, Puyallup, Wash.

[73] Assignee: Aardvark Corporation, Puyallup, Wash.

[21] Appl. No.: 650,307

[22] Filed: Feb. 4, 1991

[51] Int. Cl.[5] ..... E02F 5/10

[52] U.S. Cl. ..... 405/184; 405/259.1

[58] Field of Search ..... 405/259, 258, 184; 37/193

[56] References Cited

U.S. PATENT DOCUMENTS

| | | | |
|---|---|---|---|
| 3,391,543 | 7/1968 | Sweeney | 405/259 |
| 4,648,746 | 3/1987 | Abinett | 405/184 |
| 4,710,065 | 12/1987 | Leppänen | 405/259 X |
| 4,738,565 | 4/1988 | Streatfield et al. | 405/184 X |
| 4,789,268 | 12/1988 | Yarnell | 405/184 X |
| 4,911,579 | 3/1990 | Lutz et al. | 405/184 |
| 4,936,708 | 6/1990 | Perry | 405/184 |

*Primary Examiner*—Dennis L. Taylor
*Assistant Examiner*—Russell McBee
*Attorney, Agent, or Firm*—Christopher Duffy

[57] ABSTRACT

A tubular casing 2 is installed in a tunnel 82 in the earth and the rod 14, 49 is advanced telescopically through the bore of the casing until a portion 49 of the rod is projected into the tunnel ahead of the casing, whereupon a pair of harpoon-like detents 138 anchor that portion of the rod to the wall of the tunnel so that the casing can be retracted in the opposite direction to remove it from around the remainder of the rod. When the distal end of the casing requires a cap 16 because the earth is unstable, pressurized fluid is applied to a piston-like insert 18 in the bore of the casing, to eject the cap and then the insert itself, before the rod is projected into the tunnel. Moreover, when the cap is equipped with a tunneling tool 74 and the casing is used to excavate its own tunnel, the fluid is ejected into the excavation through openings 120 and 80 in the insert and the cap, respectively, to assist the casing in excavating the tunnel; and when the casing is installed, the rod is used as a stopper 136 in the opening 120 of the insert, to plug it while the fluid ejects the insert. Then, the rod is projected into the tunnel ahead of the casing.

65 Claims, 5 Drawing Sheets

16
20
26
36
38
40
42
44
46
48
49
50
52
54
56
60
62
64
66
68
70
72
74
76
78
80
88
90
92
94
96
98
100
101
102
104
106
108
110
112
114
116
118
120
122
124
125
126
130
132
134
136
138
140
142
144
146
148
150
152
154
156
158
160

APPARATUS AND TECHNIQUE FOR INSTALLING AN ELONGATED ROD IN AN EARTH FORMATION

DESCRIPTION

TECHNICAL FIELD

The present invention relates to an apparatus and technique for installing an elongated rod in an earth formation, and particularly the installation of such a rod in an unstable earth formation, that is, one which tends to collapse and fill any excavation made in it.

The invention is applicable to the installation of any elongated rod which can be relatively advanced telescopically through the length of an elongated tubular casing, in the longitudinally extending bore thereof, and then dismounted from the casing at the distal end of the bore, so as to assume a position in which it is disposed relatively tandemly ahead of the casing in, for example, an excavation made in an earth formation. This includes those rods which are hollow and those which are solid, those rods which are perforate and those which are imperforate, and those which are formed in part in the casing as with a cure hardenable grout, as well as those which are formed entirely outside of the casing and then inserted into it thereafter. For example, the invention is applicable to the installation of a horizontal drain in an aquifer for purposes of relieving it of the water. In such a case, the "rod" is both perforate and hollow to collect and drain the water to some point outside of the aquifer. On the other hand, the invention is also applicable to the installation of so-called "soil anchors." A soil anchor consists essentially of a block of concrete or similar material which is installed in an earth formation about a smaller diameter rod for purposes of anchoring a retaining wall or some other artificial structure to the formation. In this instance, of course, the "rod" is both solid and formed in situ.

BACKGROUND ART

In U.S. Pat. No. 3,391,543, an apparatus and technique were disclosed for installing such rods in earth formations, including ones which were unstable. The rod was inserted in the longitudinally extending bore of an elongated tubular casing installed in a tunnel in the earth formation, and then the casing was retracted from the tunnel while a piston device was relatively advanced telescopically through the bore of the casing behind the rod, to "extrude" the rod into the tunnel relatively tandemly ahead of the casing. Initially, the casing was capped by a tunneling tool used to install it in the earth formation, but once the rod had been inserted in the bore of the casing, the tool was removed and the rod was relatively advanced into the tunnel from the casing at the distal end of the bore as indicated. Moreover, where the earth formation was unstable, a pressurized liquid medium was charged into the bore about the rod to stabilize the formation while the rod was dismounted in the tunnel. The pressurized liquid medium was admitted to the bore through a check valve in the piston device, and in addition, was replenished from time-to-time to maintain the charge in the tunnel while the operation continued. Ultimately, when the rod had been dismounted in the tunnel, relatively tandemly ahead of the casing, the charge was discontinued and the casing was removed from the mouth of the tunnel to leave the rod encased in the earth formation, except perhaps for the proximal end of the rod which was exposed for use at the face of the excavation.

While the patented apparatus and technique were highly advantageous in their own right, they did have the disadvantage that the bore of the casing had to be uniform in cross section throughout its length, so that the casing and the piston device could be reciprocated in relation to one another for the full length of the casing.

DISCLOSURE OF THE INVENTION

The apparatus and technique of the present invention are equally advantageous, but no longer require a casing having a uniform bore. In fact, they can be used with a casing having a bore of any cross section which allows the rod to be relatively advanced telescopically through the length of it and then dismounted from it at the distal end of the bore, as explained above. One example of such a casing is that assembled from lengths of tubing having internal upset tool joints at the connections therebetween. Other examples will become apparent from the description of the invention which follows hereafter.

As explained then, the present apparatus and technique also employ an elongated tubular casing which is installed in a tunnel in the earth formation, and once again, the rod is relatively advanced telescopically through the length of the casing in the longitudinally extending bore thereof, and then relatively advanced into the tunnel from the casing at the distal end of the bore. However, rather than "extrude" the rod, as was done in the past, the present apparatus and technique now anchor the rod to the wall of the tunnel, and retract the casing in the direction of the mouth of the tunnel to uncover it from around the rod while the rod is anchored to the wall. More particularly, after the rod has been relatively advanced telescopically through the length of the casing as indicated, it is then relatively advanced into the tunnel from the casing at the distal end of the bore to the extent that a portion of the rod is projected into the tunnel relatively tandemly ahead of the casing, and the rod is anchored to the wall of the tunnel at the relatively tandemly projected portion thereof, while the casing is retracted in the direction of the mouth of the tunnel to uncover the casing from around the remainder of the rod.

In many of the presently preferred embodiments of the invention, for example, the rod is anchored to the wall of the tunnel by interengaging an anchoring device between the relatively tandemly projected portion of the rod and the wall of the tunnel. Sometimes, moreover, the anchoring device is projected into the tunnel from the casing at the distal end thereof, and in fact, relatively advanced into the tunnel contemporaneously with the rod. In fact, in certain embodiments, the anchoring device is relatively advanced into the tunnel by the rod itself, and in some of these, it is relatively advanced into the tunnel on the distal end portion of the rod.

To illustrate, in one group of embodiments, the anchoring device takes the form of a detent forming device which is mounted on the sides of the rod so as to be collapsible within the bore of the casing when the rod is relatively advanced telescopically through the length of the casing in the bore thereof, but then expansible relatively laterally outwardly of the rod to interengage between the relatively tandemly projected portion of the rod and the wall of the tunnel when the rod is relatively advanced into the tunnel from the casing at the distal end of the bore. In some of the group, the detent forming device includes a pair of detents which are reciprocably mounted on opposing sides of the rod so as to be retractable within the bore of the casing when the rod is relatively advanced telescopically through the length of the casing in the bore thereof, but yieldably biased to reciprocate into engagement with the wall of the tunnel when the rod is relatively advanced into the tunnel from the casing at the distal end of the bore. Moreover, certain of the group employ a scheme wherein the distal end portion of the rod has a laterally outwardly opening recess therein, and the detents are reciprocably mounted on the distal end portion of the rod to be compressed against the bias thereon, relatively into the recess, by the wall of the bore in the casing, when the distal end portion of the rod is relatively advanced telescopically through the length of the casing in the bore thereof, but then released from the recess, laterally outwardly of the rod, for reciprocation into engagement with the wall of the tunnel, under the bias thereon, when the distal end portion of the rod is relatively advanced into the tunnel from the casing at the distal end of the bore.

If the earth formation has a high liquid content, or worse yet, if it is unstable, the apparatus and technique may also employ certain additional features which are designed to deal with the condition. In such a case, for example, the user need not shy away from using a rod which is tubular because while the main body of it may be tubular, the distal end of it may be closed by an extension thereof which has the anchoring device supported on it. Furthermore, an annular gland may be relatively telescopically interengaged between the rod and the wall of the bore to prevent liquid from flowing through the bore in the direction relatively toward the proximal end thereof when the rod is relatively advanced into the tunnel from the casing at the distal end of the bore. And moreover, if desired, the gland may be adapted to allow liquid to pass through the bore in the direction relatively toward the distal end thereof, and a pressurized liquid medium may be charged into the bore for discharge about the rod at the distal end of the bore when the rod is relatively advanced into the tunnel from the casing at the distal end of the bore.

In fact, the casing may have a cap on the distal end portion thereof which is operable to close the distal end of the bore to the earth formation, and the cap may be removed from the distal end of the bore to open the same for the advance of the rod into the tunnel therethrough when the rod is relatively advanced into the tunnel from the casing at the distal end of the bore.

Sometimes a pressurized fluid medium is charged into the casing to remove the cap from the distal end of the bore. For example, in certain of the presently preferred embodiments of the invention, the cap is connected to the distal end portion of the casing so as to be removable from the casing by relatively endwise displacement thereof, the bore has a piston-like insert therein which is displaceable endwise of the bore to displace the cap relatively endwise of the casing and then eject into the tunnel from the casing at the distal end of the bore, and a pressurized fluid medium is charged into the bore to displace the insert in the direction of the distal end of the bore and thereby remove the cap from the casing and eject the insert into the tunnel from the distal end of the bore to open the same for the advance of the rod into the tunnel therethrough. In some embodiments, the cap is telescopically engaged about the distal end portion of the casing and fastened to the same by a shear pin, and the cap is unfastened from the casing by retracting the casing in the direction of the mouth of the tunnel while the pressurized fluid medium is applied to the insert to pressurize the same against the cap and thereby reciprocate the cap and the casing in relation to one another to shear the pin, the cap being removed from the casing thereafter by continued retraction of the casing in the direction of the mouth of the tunnel while the pressurized fluid medium is applied to the insert to eject the same from the distal end of the bore.

Where desired, the casing may also be used to excavate its own tunnel in the earth formation. For example, where the casing is equipped with a cap, the cap may be equipped in turn with a tunneling tool, and the casing may be installed in the tunnel by driving it into the earth formation behind the tool to excavate its own tunnel therein. In addition, where desired, a pressurized fluid medium may be discharged from the cap during the tunnel excavating operation, to flush the excavated debris from the tunnel. In certain embodiments of the invention, for example, the cap is ported and connected to the distal end portion of the casing so as to be removable from the casing by relatively endwise displacement thereof, the bore has a piston-like insert therein which is displaceable relatively endwise of the bore to displace the cap relatively endwise of the casing and then eject into the tunnel from the distal end of the bore, and the insert has an opening therein for passing a fluid medium therethrough between the bore and the port of the cap. The opening has a check valve therein which is disposed so that a pressurized fluid medium can be charged into the bore for discharge into the tunnel through the opening and the port of the cap to flush the excavated debris from the tunnel, but the valve will close to isolate the bore of the casing from the tunnel when the fluid discharge is discontinued. The casing is installed in the tunnel by driving it into the earth formation behind the tool while a pressurized fluid medium is discharged through the port of the cap to excavate the tunnel in the earth formation; then a stopper is inserted in that entrance to the opening of the insert which lies adjacent the bore, to close the insert to the passage of fluid therethrough, and a pressurized fluid medium is charged into the bore to displace the insert in the direction of the distal end of the bore and thereby remove the cap from the casing and eject the insert into the tunnel from the distal end of the bore, to open the same for the advance of the rod into the tunnel therethrough.

In a special group of embodiments, the stopper is formed on the distal end of the rod and inserted in the entrance to the opening of the insert when the rod is telescopically advanced through the length of the casing in the bore thereof. Moreover, in some of these latter embodiments, the rod is anchored to the wall of the tunnel in the manner revealed earlier, that is, by interengaging an anchoring device between the relatively tandemly projected portion of the rod and the wall of the tunnel, and the anchoring device is relatively advanced into the tunnel from the casing on the distal end portion of the rod, that is, on that same portion of the rod which has the stopper at the remote end thereof.

In one particularly advantageous group of embodiments, the cap takes the form of a ported, detachable bit which is diametrically oversized relative to the casing, and the casing is employed as a drill rod and liquid swivel for the bit in the tunnel excavating operation, while the debris excavated from the earth formation is flushed from the tunnel through the annulus formed between the casing and the wall of the tunnel. The anchoring device of choice in some of these embodiments, comprises an elongated carrier device which is securable at one end to the distal end of the rod. The carrier device has means thereon defining a laterally outwardly opening recess therein, and it also has a pair of elongated harpoon-like detents thereon which are rotatably mounted on opposing sides of the carrier device so as to be retractable relatively into the recess when the carrier device is relatively advanced on the rod telescopically through the length of the casing in the longitudinally extending bore thereof. However, there are means on the carrier device for yieldably biasing the detents to reciprocate laterally outwardly of the recess into engagement with the wall of the tunnel when the carrier device is relatively advanced into the tunnel from the casing at the distal end of the bore. In one particular anchoring device of note, the carrier device has a stopper on the opposing end thereof for insertion in the entrance to the opening in the insert of the bore. Thus, the anchoring device is both a stopper forming device and a detent forming device, and it is, of course, relatively advanced into the tunnel by the rod itself when the rod is relatively advanced into the tunnel from the casing at the distal end of the bore.

BRIEF DESCRIPTION OF THE DRAWINGS

These features will be better understood by reference to the accompanying drawings which illustrate one of the latter embodiments of the invention when the apparatus and technique of the same are employed to install a perforated pipe which can serve as a horizontal drain for excess water or other liquid in an earth formation.

In the drawings.

BEST MODE FOR CARRYING OUT THE INVENTION

Figure 1:
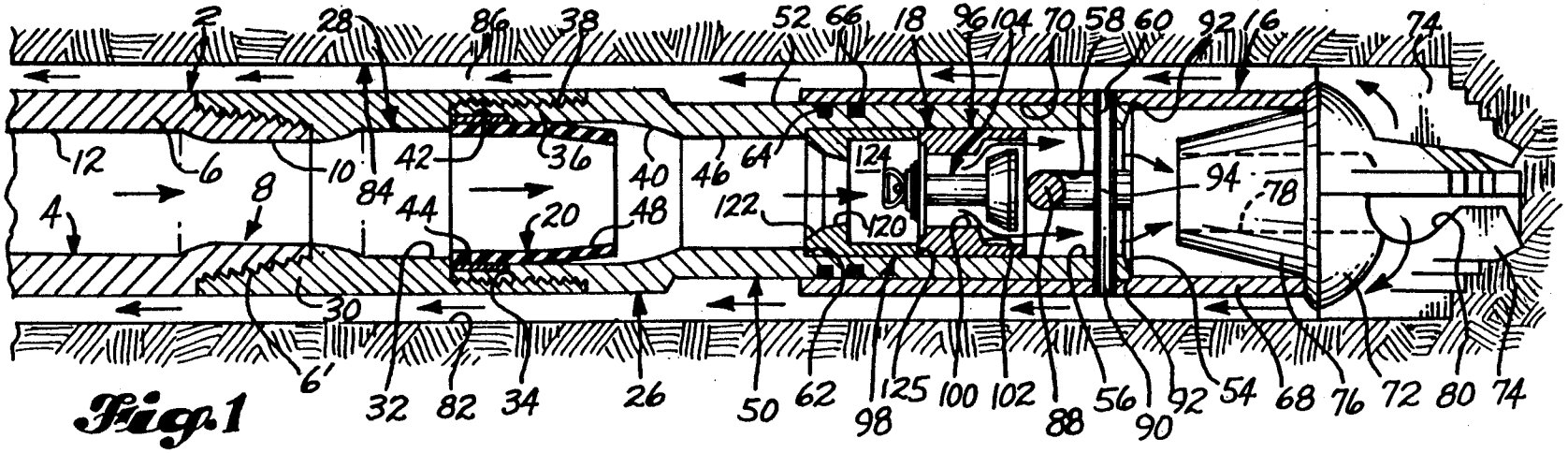
FIG. 1 is a longitudinal part cross sectional view of the distal end portion of the casing when the casing is equipped with such a ported, detachable bit, an insert, and a gland, and is being employed as a drill rod and liquid swivel for the bit in the tunnel excavating operation.

Referring to the drawings, it will be seen that the casing 2 is assembled from ten foot sections 4 of cylindrical steel tubing, which each have opposing end portions 6 that are internally belled and spigotted, respectively, and threaded internally and externally thereof, respectively, to enable the sections to be threaded together to form an elongated string of the same having internal upset tool joints 8 at the connecting ends thereof. Given such joints 8, and the reduced diameter throats 10 thereof, the bore 12 of the casing has a non-uniform cross section so that the piston-like device (not shown) employed in U.S. Pat. No. 3,391,543, cannot be used in the dismounting of an elongated rod, such as the horizontal drain pipe 14, from the casing 2. Instead, the bit 16, insert 18 and gland 20 of the present invention must be employed with the casing, and a stopper and detent forming device of the type mentioned, must be employed on the rod. Reference will now be made to that assembly, and to that device, and to the technique employed with it, therefore, bearing in mind, however, that the drive mechanism 22 and the pump mechanism 24 employed with the patented assembly, are equally applicable to the rotating, advancing and retracting of the present assembly, and the pressurization of the same.

Referring first to the casing assembly, it will be seen that the casing 2 is spigotted at the distal end 6' thereof, and a tubular adaptor 26 having the same diameter as that of the casing is flush coupled to the end of the casing to provide a carrier for the bit 16, the insert 18, and the gland 20. In order to accommodate the gland 20 in the rear end portion of the adaptor, however, a special coupling 28 is interposed between the adaptor 26 and the casing 2. The coupling 28 is internally constricted at the rear end 30 thereof, and the rear end is deeply rabbeted, tapered, and threaded to engage with the spigotted end 6' of the casing. Forward of the end 30, however, the bore 32 of the coupling is the same as that 12 of the casing, and a wide diameter rabbet 34 is formed and threaded about the mouth of the bore to enable a conventional male/female joint to be formed between the coupling and the rear end portion 36 of the adaptor, which has a similarly threaded rabbet 38 at the outer periphery thereof for the joint. At its inside, meanwhile, the latter end portion 36 of the adaptor is deeply counterbored to provide an entry chamber 40 within which to mount the gland 20. The wall of the chamber 40 is slightly wider than the bore 32 of the coupling, and is rabbetted for a short distance at its rear end to provide a seat 42 within which to mount a collar 44 affixed to the outside of the gland. At its forward end, however, the wall of the chamber is smoothly constricted, so that where it merges into the bore 46 of the adaptor, it has a diameter slightly smaller than those 32 and 12 of the coupling and the casing. The gland 20, meanwhile, is elastomeric and in the shape of an elongated sleeve, the forward end 48 of which is constricted to form a conical tip. The tip 48 is slightly smaller in diameter than that of the throats 10, so that when the stopper and detent forming device 49 and the pipe 14 are successively slideably advanced through the respective throats, and then the gland itself, the tip 48 is distended by each as it passes, so as to form a sliding seal around each and the pipe in particular. See FIG. 6. In addition, the tip 48 is also capable of additional distension thereafter, so that water or some other liquid medium can be charged into the bore 12 of the casing, and thence through the gland 20, around the pipe 14, to reach the forward end portion 50 of the adaptor for purposes connected with the respective tunnel excavating and pipe dismounting operations, as shall be explained. When the pressure on the liquid medium is released, however, the medium will not escape in the reverse direction because of the seal provided by the gland.

The forward end portion 50 of the adaptor is barrel-like in shape, and has a deeply inset outer peripheral rabbet 52 about the chamfered end 54 thereof, and a counterbore 56 of shorter length at the inner periphery thereof, to accommodate the bit 16 and the insert 18, respectively. The barrel 50 also has a pair of diametrically opposing slots 58 in its distal end 54, and a pair of holes 60 in the distal end portion thereof which are disposed in a diametral plane at right angles to that of the slots 58. Midway of its length, moreover, near the shoulder 62 of the counterbore 56, the barrel 50 has a pair of circumferential grooves 64 that extend about the outside rabbet 52 of the barrel and are equipped with a pair of elastomeric rings 66 for sealing the joint between the adaptor and the bit 16 when the bit is mounted on the adaptor, as shall be explained.

The bit 16 comprises a sleeve 68, the rear end portion of which has a deeply inset rabbet 70 at the inner periphery thereof, and the distal end of which has a chamfered, part spherical head 72 thereon, the part spherical face of which has a set of slightly canted but symmetrically angularly offset blades 74 projecting therefrom, endwise of the bit. Inside of the sleeve, moreover, the bit has a rearwardly projecting boss 76 on the head 72 thereof. The boss 76 is conical in shape and has an axial opening 78 therethrough, that opens into the part spherical face of the head at a series of ports 80 interposed between the respective pairs of blades 74. The blades themselves are toothed and extend not only endwise of the head, but also laterally outwardly thereof so as to generate a diametrically oversized tunnel 82 when the bit 16 is augured into an earth formation 84 on the end of the adaptor 26. This in turn provides an annulus 86 between the casing 2 and the wall of the tunnel, through which the pressurized liquid medium mentioned earlier, can be discharged from the bit to flush the excavated debris from the tunnel 82 during the tunnel excavating operation, as shall be explained.

Figure 2:
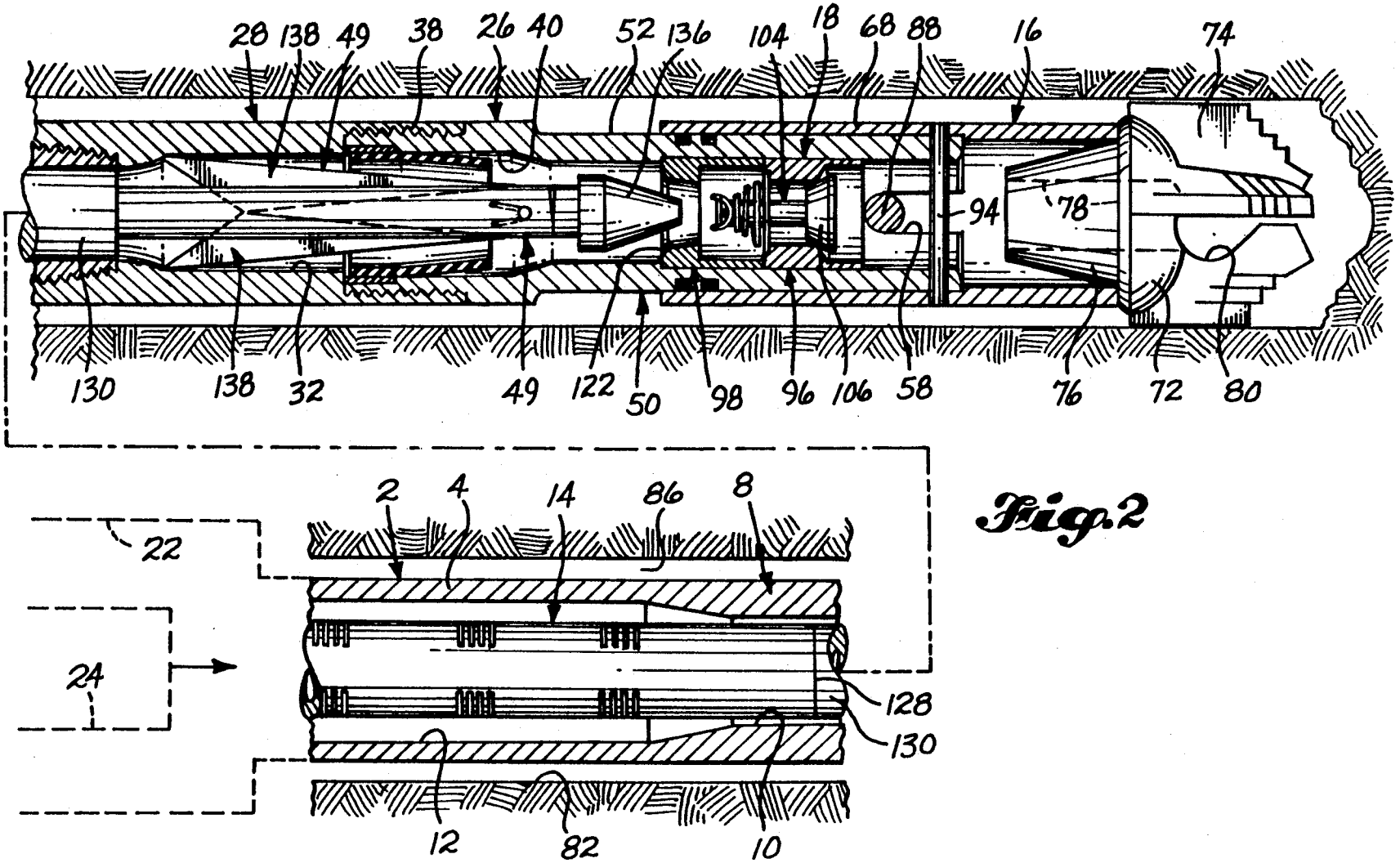
FIG. 2 is a similar view of the distal end portion of the casing when the tunnel excavating operation has been concluded and the drain pipe to be dismounted in the tunnel has been inserted in the casing with one of the aforementioned dual purpose anchoring devices on the distal end thereof, there also being a schematic showing of the drive mechanism for rotating, advancing and retracting the casing, and the pump mechanism for charging pressurized liquid through the same during the respective tunnel excavating and pipe dismounting operations, both of which mechanisms can be studied in more detail through a reading of the aforementioned patent which is incorporated herein by reference to it.

The bit 16 also has a large diameter drive pin 88 across the bore thereof, at one diameter of the sleeve, and a pair of holes 90 in the body of the sleeve, which are disposed at a diameter more forward than that of the pin 88, and at right angles to that of the pin, just short of the shoulder 92 of the rabbet 70 in the sleeve. In size, the sleeve 68 is adapted to be telescopically engaged about the barrel 50 of the adaptor at the respective rabbets 70 and 52 therein, and to compressably engage about the rings 66, to seal the joint between the adaptor and the sleeve, when the shoulder 92 of the rabbet 70 in the sleeve 68 abuts the end 54 of the barrel. Meanwhile, to so engage the parts, the drive pin 88 of the sleeve must be inserted in the slots 58 of the barrel, and in inserting the pin in the slots, the sleeve is oriented about the barrel to bring the holes 90 of the sleeve into registry with the holes 60 in the barrel when the drive pin engages the bottoms of the slots, as in FIGS. 1 and 2. Moreover, when the drive pin 88 engages in the slots 58, it has the effect of interengaging the bit 16 with the barrel 50 of the adaptor so that the rotation of the adaptor will rotate the bit in turn. However, to detachably fasten the bit to the barrel axially thereof, something more is needed, and for that purpose a second pin 94 is inserted through the respective pairs of holes 90 and 60, crosswise of the bores of the sleeve and the barrel. The pin 94 is constructed of readily shearable material, however, for that time when the drain pipe 14 is to be dismounted from the casing, as shall be explained.

Figure 3:
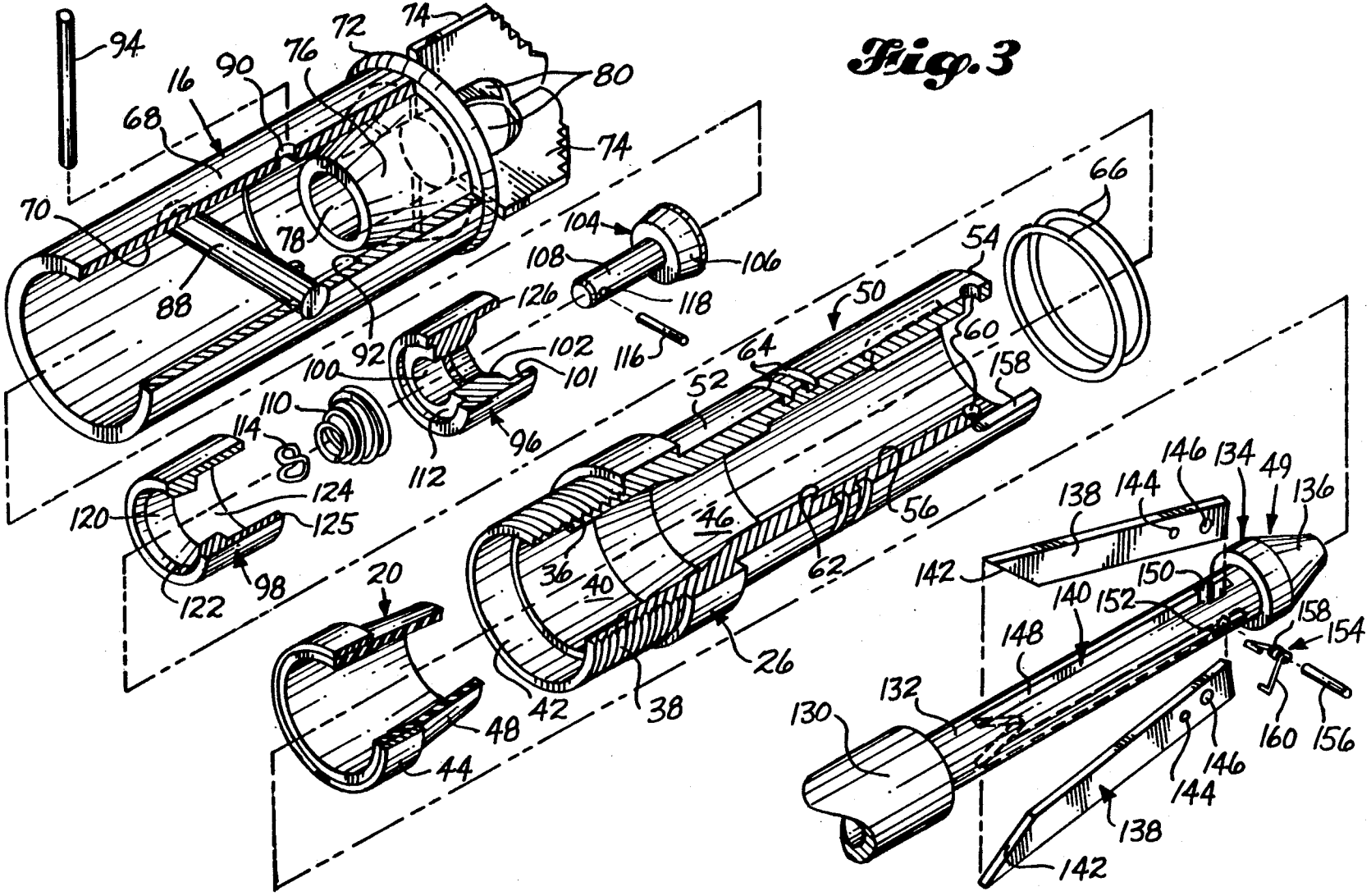
FIG. 3 is an exploded view of the distal end portion of the casing when the drain pipe has been inserted in the casing with a dual purpose anchoring device on the distal end thereof, for the operation of dismounting the drain pipe in the tunnel.

All of this is done, of course, only after the insert 18 is telescopically engaged in the counterbore 56 of the adaptor 26. Referring now to FIG. 3 in particular, it will be seen that, structurally, the insert 18 comprises not one, but a pair of plug-like members 96 and 98, each of which is annular but structured for a different function. The more forward member 96 has an axial opening 100 therethrough, the forward end 101 of which is counterbored and chamfered to form a valve seat 102 for a check valve 104 installed in the member. The check valve 104 is conventional in having a head 106 that is mitered to mate with the valve seat, and a stem 108 which extends through the opening 100 of the seat 102 and has a spring 110 coiled about the rear end thereof. The spring 110 is seated on a rabbet 112 at the inner peripheral edge of the opening 100 in the rear end of the member 96, and is retained on the stem 108 by a clip 114 that is secured to the rear end of the stem by a pin 116 that is inserted in a hole 118 in the stem. The spring 110 is thus caged between the clip 114 and the body of the member 96 to yieldably bias the head 106 of the valve 104 into the closed position thereof, but the pressurized liquid mentioned earlier can nevertheless pass through the spring to enter the opening 100 of the member 96 and displace the head against the bias of the spring, when it is desired to use the casing as a drill rod and water swivel for the bit in the tunnel excavating operation. The liquid then flows past the pins 88 and 94 into the axial opening 78 of the bit, and thence out the ports 80 of the bit for reentrant flow through the annulus 86, as shown by the succession of arrows in FIG. 1.

The more rearward member 98 of the insert has an axial opening 120 which is flared to the rear, and then mitered still further at the mouth thereof to form a valve seat 122 for the pipe dismounting operation, as shall be explained. At its forward end, the opening 120 is widely and deeply counterbored to form a vestibule 124 in which to receive the spring 110 and stem 108 of the check valve 104 when the two members 96 and 98 are mounted in tandem with one another in the adaptor.

In assembling the insert 18, the more rearward member 98 is telescopically engaged in the counterbore 56 of the adaptor 26 until it abuts the shoulder 62 of the counterbore, and then the more forward member 96 is telescopically engaged behind it and abutted against the distal end 125 of it in turn. When the two members have been tandemly abutted in this fashion, the distal end 126 of the more forward member 96 will have assumed a position in which it is coincident with the bottoms of the slots 58 in the adaptor, so that when the drive pin 88 of the bit is engaged in the slots, the pin will abut the bottoms of the slots just short of the distal end 126 of the insert. Moreover, with the addition of the shear pin 94 to the holes 90 and 60, the insert will have been effectively trapped in the counterbore 56 by the bit, so that when pressurized liquid is charged through the valve 104 of the insert in the tunnel excavating operation, the liquid charge will not dislodge the insert. On the other hand, when the tunnel 82 has been excavated to the required length, and the pump mechanism 24 turned off, the closure of the valve 104 will isolate the bore 12 of the casing from the earth formation, so that the apparatus can be used next for the installation of the drain pipe 14 in the tunnel 82 by further steps of the inventive process.

The installation steps are begun by telescopically advancing the drain pipe 14 through the casing 2 in the bore 12 thereof, with the stopper and detent forming device 49 on the distal end 128 thereof. Referring now to FIGS. 2–6 in particular, it will be seen that the device 49 comprises a solid cylindrical boss 130 which is screwed, pinned or otherwise affixed to the distal end 128 of the pipe 14 and has a lengthy smaller diameter extension 132 thereon, which terminates in a larger diameter head 134 that has a truncated conical tip 136 at the distal end thereof. The boss 130 operates to close the distal end 128 of the pipe, while the tip 136 of the head 134 is insertable in the axial opening 120 of the member 98 at the rear end of the insert 18 to form a stopper for the same when the flanks of the tip engage the valve seat 122 of the member. The extension 132, meanwhile, is a carrier for a pair of elongated harpoon-like detents 138 which are rotatably mounted in an elongated slot 140 extending lengthwise of the extension, and are yieldably biased laterally outwardly of the slot to engage the wall of the tunnel 82 when the device 49 exits through the distal end 54 of the adaptor in the dismount operation, as shall be explained. The detents 138 have outwardly angled flukes 142 at their relatively outboard ends, and pairs of smaller and larger diameter holes 144 and 146, respectively, in their relatively inboard ends. The slot 140 is removed from the extension 132 in an axial plane thereof, and has opposing half sections 148 that are adapted to accommodate the detents 138 in side-by-side array with one another lengthwise of the slot. At their rears, the half sections 148 are tapered at the angle of the flukes 142, while at the forward end of the slot, the half sections are joined by a cross bore 150 that has opposing holes 152 at right angles to the plane of the slot. After the detents are slideably inserted in the half sections 148 of the slot 140, with the larger holes 146 thereof aligned between those 152 of the bore 150, and with a V-spring 154 interposed between the inboard ends of the detents, a pin 156 is inserted through one of the holes 152 of the cross bore, thence through the successive holes 146 of the detents and the coil 158 of the spring 154, and then the other of the holes 152, to rotatably mount the detents in the slot. In addition, the L-shaped arms 160 of the spring 154 are inserted in the smaller holes 144 of the detents, to yieldably bias the detents in the directions laterally outwardly of the slot and parallel to the plane of the slot. So long as the device 49 is contained within the apparatus, however, the detents are constrained to remain in a swept back configuration, as shown, so that the device can be telescopically advanced through the bore 12 of the casing, and from one throat 10 to the next, without interference from the detents which simply contract and expand as they are passed into and out of each throat. The throats 10 are also preferably tapered to each side thereof, so as to slow the contraction and expansion of the detents as the device is passed through each throat. Ultimately, when the device 49 is advanced through the distal end 54 of the adaptor, as shall be explained, the detents 138 are released to engage the wall of the tunnel 82, where they prevent the drain pipe 14 from being withdrawn in the direction of the mouth of the tunnel as the casing 2 is retracted about the pipe in the dismount operation now to be explained.

Figure 5:
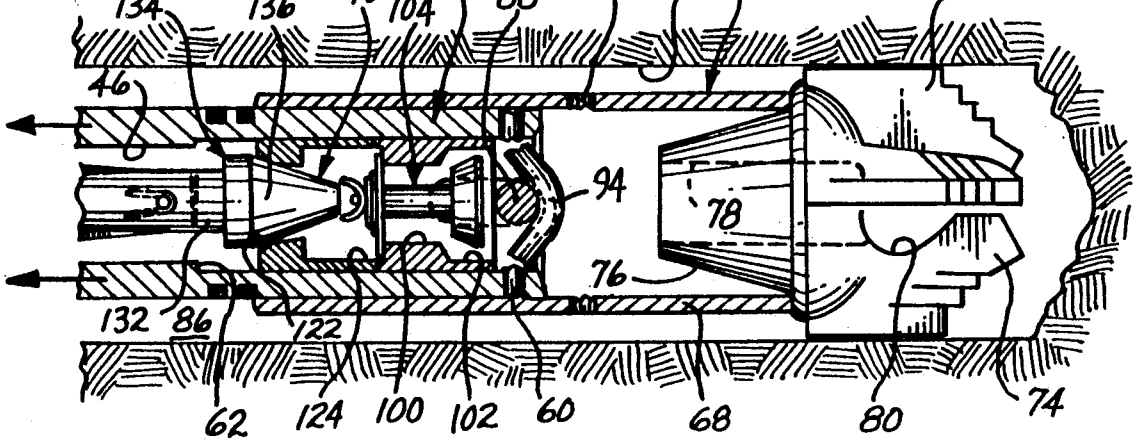
FIG. 5 is a fourth such part cross sectional view along the length of the casing when the bit has been unfastened from the casing in the dismount operation.
Figure 6:
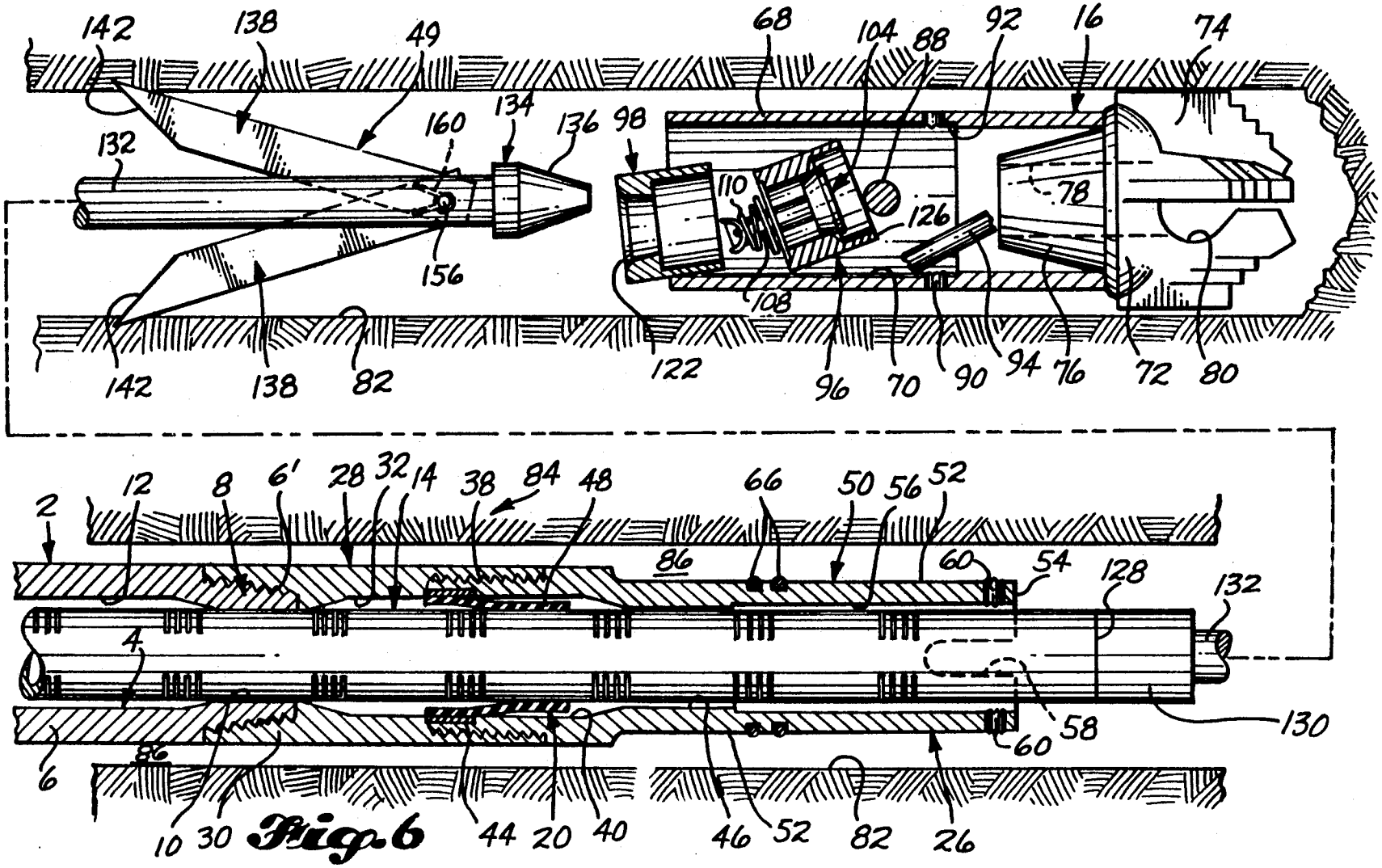
FIG. 6 is a fifth such view along the length of the casing when the insert has been ejected into the tunnel from the distal end of the casing, and the detents have engaged the wall of the tunnel so as to anchor the drain pipe to the wall while the casing is retracted about the pipe.
Figure 4:
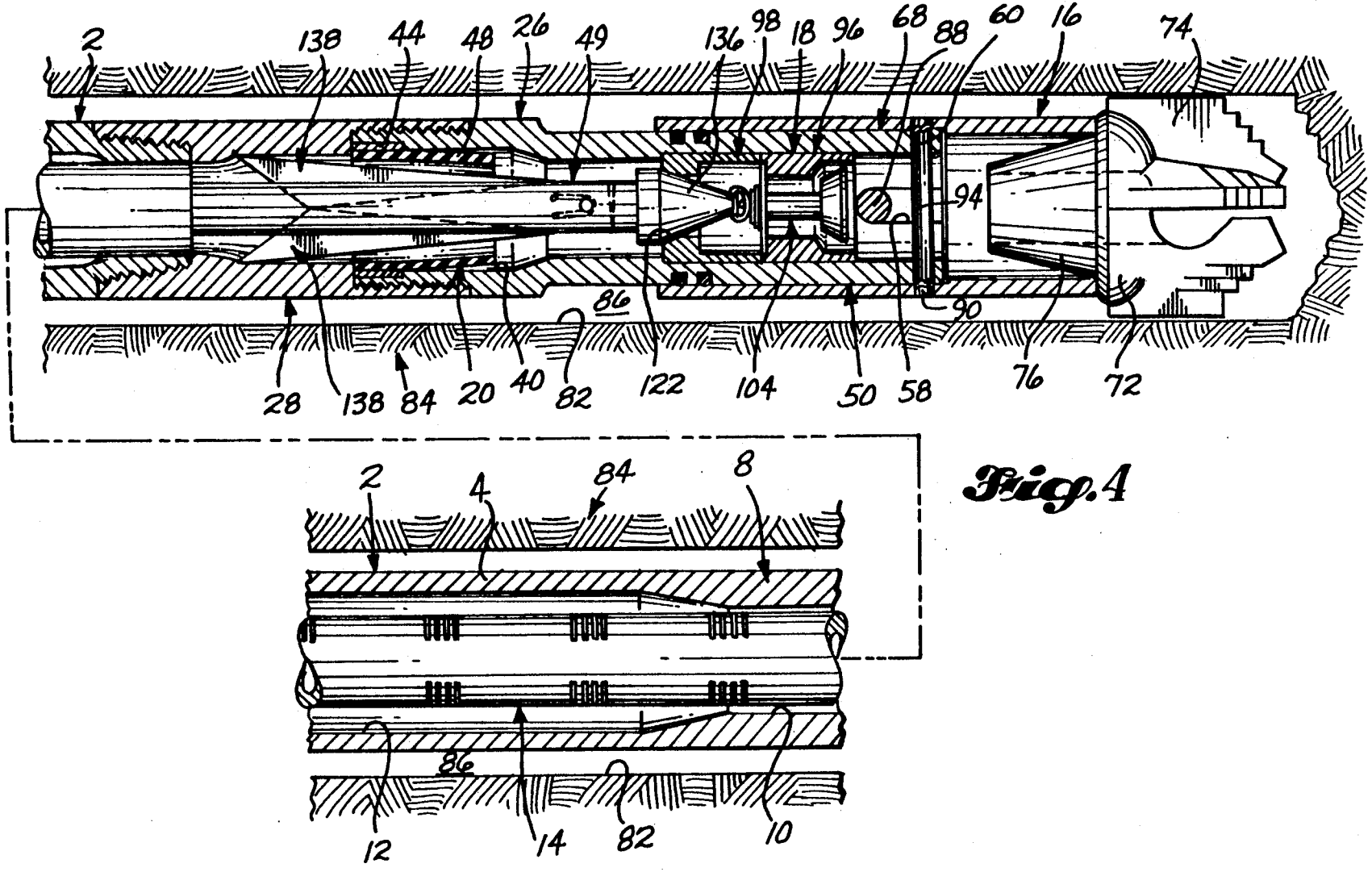
FIG. 4 is a third longitudinal part cross sectional view of the distal end portion of the casing when the dismount operation has been commenced.

Referring next to FIGS. 4–6, it will be seen that the tip 136 of the device has been engaged with the valve seat 122 of the insert 18 to close the passage 120, 100 of the insert to the flow of pressurized liquid therethrough. The tip 136 has also engaged the stem 108 of the valve 104, with the effect of opening the valve, but this is of no consequence since liquid can no longer flow through the valve because of the closure of the axial opening 120 of the member 98 by the tip of the device. The effect does permit the insert 18 to be shortened in length, however, and is included solely for that purpose, not for purposes of employing the valve 104 itself in any further way at this stage. Continuing, therefore, once the device 49 is engaged with the valve seat 122 to close the insert 18 to the flow of liquid therethrough, pressurized water is charged into the bore 12 of the casing once again, and is applied telescopically against the insert to pressurize it against the drive pin 88 of the bit 16. If then the casing 2 is given a slight "jerk" in the direction of the mouth of the tunnel, the shear pin 94 will be severed by the relative reciprocation between the bit 16 and the adaptor 26, and the bit will be free to be detached from the adaptor by the continued relative displacement of the insert in the direction of the mouth 54 of the adaptor. See FIG. 5. The drive pin 88 is disengaged from the slots 58 of the adaptor, meanwhile, and as the bit telescopically disengages from the adaptor altogether, the insert 18 is ejected along with it at the mouth 54 of the adaptor, to free the bore of the adaptor for the advance of the stopper and detent forming device 49 therethrough. Then, given continued retraction of the casing 2 in the direction of the mouth of the tunnel, the device 49 will escape entirely from the end of the bore and the detents 138 will be released to "stab" the wall of the tunnel at the flukes 142 thereof. This locks the device in the tunnel as the remainder of the casing is retracted about the pipe 14; and furthermore, if throughout this time the water is continuously discharged about the pipe, the flow of it will assure that debris cannot lodge between the pipe and the casing. Additionally, if the casing 2 is removed in successive stages, after each of which the section 4 at the end of the casing adjacent the mouth of the tunnel is detached and removed from the casing, the gland 20 will operate as a check valve in that it will admit water into the barrel 50 of the adaptor when the string of unremoved sections 4 is pressurized, but will tightly clasp the pipe to prevent debris from flowing past the gland 20 in the direction of the mouth of the tunnel when the liquid charge is discontinued for the removal of another section 4 from the string. Of course, ultimately, when the last section 4 is removed, the gland 20 will commonly be detached from the pipe 14 with it, to totally dismount the pipe in the tunnel, tandemly ahead of the casing, but with the proximal end portion of the pipe (not shown) protruding from the face of the formation to discharge the water or other liquid to be drained from the formation.

I claim:

1. In the process of installing an elongated rod in an earth formation, the steps of:

installing in a tunnel in the earth formation, an elongated tubular casing having a longitudinally extending bore therethrough, relatively advancing the rod telescopically through the length of the casing in the bore thereof, and thence into the tunnel from the casing at the distal end of the bore, to the extent that a portion of the rod is projected into the tunnel relatively tandemly ahead of the casing, anchoring the rod to the wall of the tunnel at the relatively tandemly projected portion of the rod, and retracting the casing in the direction of the mouth of the tunnel to uncover the casing from around the remainder of the rod while the rod is anchored to the wall of the tunnel.

2. The process according to claim 1 wherein the rod is anchored to the wall of the tunnel by interengaging an anchoring device between the relatively tandemly projected portion of the rod and the wall of the tunnel.

3. The process according to claim 2 wherein the anchoring device is projected into the tunnel from the casing at the distal end thereof.

4. The process according to claim 3 wherein the anchoring device is relatively advanced into the tunnel contemporaneously with the rod.

5. The process according to claim 3 wherein the anchoring device is relatively advanced into the tunnel by the rod itself.

6. The process according to claim 3 wherein the anchoring device is relatively advanced into the tunnel on the distal end portion of the rod.

7. The process according to claim 2 wherein the anchoring device takes the form of a detent forming device which is mounted on the sides of the rod so as to be collapsible within the bore of the casing when the rod is relatively advanced telescopically through the length of the casing in the bore thereof, but then expansible relatively laterally outwardly of the rod to interengage between the relatively tandemly projected portion of the rod and the wall of the tunnel when the rod is relatively advanced into the tunnel from the casing at the distal end of the bore.

8. The process according to claim 7 wherein the detent forming device includes a pair of detents which are reciprocably mounted on opposing sides of the rod so as to be retractable within the bore of the casing when the rod is relatively advanced telescopically through the length of the casing in the bore thereof, but yieldably biased to reciprocate into engagement with the wall of the tunnel when the rod is relatively advanced into the tunnel from the casing at the distal end of the bore.

9. The process according to claim 8 wherein the distal end portion of the rod has a laterally outwardly opening recess therein, and the detents are reciprocably mounted on the distal end portion of the rod to be compressed against the bias thereon, relatively into the recess, by the wall of the bore in the casing, when the distal end portion of the rod is relatively advanced telescopically through the length of the casing in the bore thereof, but then released from the recess, laterally outwardly of the rod, for reciprocation into engagement with the wall of the tunnel, under the bias thereon, when the distal end portion of the rod is relatively advanced into the tunnel from the casing at the distal end of the bore.

10. The process according to claim 2 wherein the main body of the rod is tubular but the distal end thereof is closed by an extension thereof which has the anchoring device supported thereon.

11. The process according to claim 1 further comprising relatively telescopically interengaging an annular gland between the rod and the wall of the bore to prevent liquid from flowing through the bore in the direction relatively toward the proximal end thereof when the rod is relatively advanced into the tunnel from the casing at the distal end of the bore.

12. The process according to claim 11 wherein the gland is adapted to allow liquid to be passed through the bore in the direction relatively toward the distal end thereof, and a pressurized liquid medium is charged into the bore for discharge about the rod at the distal end of the bore when the rod is relatively advanced into the tunnel from the casing at the distal end of the bore.

13. The process according to claim 1 wherein the casing has a cap on the distal end portion thereof which is operable to close the distal end of the bore to the earth formation, and the cap is removed from the distal end of the bore to open the same for the advance of the rod into the tunnel therethrough when the rod is relatively advanced into the tunnel from the casing at the distal end of the bore.

14. The process according to claim 13 wherein a pressurized fluid medium is charged into the casing to remove the cap from the distal end of the bore.

15. The process according to claim 13 wherein the cap is connected to the distal end portion of the casing so as to be removable from the casing by relatively endwise displacement thereof, the bore has a piston-like insert therein which is displaceable relatively endwise of the bore to displace the cap relatively endwise of the casing and then eject into the tunnel from the casing at the distal end of the bore, and a pressurized fluid medium is charged into the bore to displace the insert in the direction of the distal end of the bore and thereby remove the cap from the casing and eject the insert into the tunnel from the distal end of the bore to open the same for the advance of the rod into the tunnel therethrough.

16. The process according to claim 15 wherein the cap is telescopically engaged about the distal end portion of the casing and fastened to the same by a shear pin, and the cap is unfastened from the casing by retracting the casing in the direction of the mouth of the tunnel while the pressurized fluid medium is applied to the insert to pressurize the same against the cap and thereby reciprocate the cap and the casing in relation to one another to shear the pin, the cap being removed from the casing thereafter by continued retraction of the casing in the direction of the mouth of the tunnel while the pressurized fluid medium is applied to the insert to eject the same from the distal end of the bore.

17. The process according to claim 13 wherein the cap is equipped with a tunneling tool, and the casing is installed in the tunnel by driving it into the earth formation behind the tool to excavate its own tunnel therein.

18. The process according to claim 17 wherein a pressurized fluid medium is discharged from the cap during the tunnel excavating operation, to flush the excavated debris from the tunnel.

19. The process according to claim 17 wherein the cap is ported and connected to the distal end portion of the casing so as to be removable from the casing by relative endwise displacement thereof, the bore has a piston-like insert therein which is displaceable relatively endwise of the bore to displace the cap relatively endwise of the casing and then eject into the tunnel from the casing at the distal end of the bore, the insert has an opening therein for passing a fluid medium therethrough between the bore and the port of the cap, the opening has a check valve therein which is disposed so that a pressurized fluid medium can be charged into the bore for discharge into the tunnel through the opening and the port of the cap to flush the excavated debris from the tunnel, but the valve will close to isolate the bore of the casing from the tunnel when the fluid discharge is discontinued, and wherein the casing is installed in the tunnel by driving it into the earth formation behind the tool while a pressurized fluid medium is discharged through the port of the cap to excavate the tunnel in the earth formation, then a stopper is inserted in that entrance to the opening of the insert which lies adjacent the bore, to close the insert to the passage of fluid therethrough, and a pressurized fluid medium is charged into the bore to displace the insert in the direction of the distal end of the bore and thereby remove the cap from the casing and eject the insert into the tunnel from the distal end of the bore to open the same for the advance of the rod into the tunnel therethrough.

20. The process according to claim 19 wherein the stopper is formed on the distal end of the rod and inserted in the entrance to the opening of the insert when the rod is telescopically advanced through the length of the casing in the bore thereof.

21. The process according to claim 20 wherein the rod is anchored to the wall of the tunnel by interengaging an anchoring device between the relatively tandemly projected portion of the rod and the wall of the tunnel, and the anchoring device is relatively advanced into the tunnel from the casing on the distal end portion of the rod.

22. The process according to claim 19 wherein the cap takes the form of a ported, detachable bit which is diametrically oversized relative to the casing, and the casing is employed as a drill rod and liquid swivel for the bit in the tunnel excavating operation, while the debris excavated from the formation is flushed from the tunnel through the annulus formed between the casing and the wall of the tunnel.

23. In the process of installing an elongated rod in an earth formation, the steps of:

installing in a tunnel in the earth formation, an elongated tubular casing having a longitudinally extending bore therethrough, a cap which is connected to the distal end portion of the casing so as to close the distal end of the bore to the earth formation, but is removable from the casing by relative endwise displacement thereof, and a piston-like insert in the bore which is displaceable relatively endwise of the bore to displace the cap relatively endwise of the casing and then eject into the tunnel from the casing at the distal end of the bore, relatively telescopically advancing the rod into the bore of the casing at the proximal end thereof, charging a pressurized fluid medium into the bore to displace the insert in the direction of the distal end of the bore and thereby remove the cap from the casing and eject the insert into the tunnel from the distal end of the bore to open the same for the advance of the rod into the tunnel therethrough, and relatively advancing the rod into the tunnel from the casing at the distal end of the bore to dismount the rod relatively tandemly ahead of the casing in the tunnel.

24. The process according to claim 23 wherein the cap is telescopically engaged about the distal end portion of the casing and fastened to the same by a shear pin, and the cap is unfastened from the casing by retracting the casing in the direction of the mouth of the tunnel while the pressurized fluid medium is applied to the insert to pressurize the same against the cap and thereby reciprocate the cap and the casing in relation to one another to shear the pin, the cap being removed from the casing thereafter by continued retraction of the casing in the direction of the mouth of the tunnel while the pressurized fluid medium is applied to the insert to eject the same from the distal end of the bore.

25. The process according to claim 23 wherein the cap is equipped with a tunneling tool, and the casing is installed in the tunnel by driving it into the earth formation behind the tool to excavate its own tunnel therein.

26. The process according to claim 25 wherein a pressurized fluid medium is discharged from the cap during the tunnel excavating operation, to flush the excavated debris from the tunnel.

27. The process according to claim 25 wherein the cap is ported and the insert has an opening therein for passing a fluid medium therethrough between the bore and the port of the cap, the opening has a check valve therein which is disposed so that a pressurized fluid medium can be charged into the bore for discharge into the tunnel through the opening and the port of the cap to flush the excavated debris from the tunnel, but the valve will close to isolate the bore of the casing from the tunnel when the fluid discharge is discontinued, and wherein the casing is installed in the tunnel by driving it into the earth formation behind the tool while a pressurized fluid medium is discharged through the port of the cap to excavate the tunnel in the earth formation, then a stopper is inserted in that entrance to the opening of the insert which lies adjacent the bore, to close the insert to the passage of fluid therethrough, and a pressurized fluid medium is charged into the bore to displace the insert in the direction of the distal end of the bore and thereby remove the cap from the casing and eject the insert into the tunnel from the distal end of the bore to open the same for the advance of the rod into the tunnel therethrough.

28. Apparatus for installing an elongated rod in an earth formation, comprising:

an elongated tubular casing having a longitudinally extending bore therethrough, means for installing the casing in a tunnel in the earth formation, so that the rod can be relatively advanced telescopically through the length of the casing in the bore thereof, and thence into the tunnel from the casing at the distal end of the bore, to the extent that a portion of the rod is projected into the tunnel relatively tandemly ahead of the casing, means for anchoring the rod to the wall of the tunnel at the relatively tandemly projected portion of the rod, and means for retracting the casing in the direction of the mouth of the tunnel to uncover the casing from around the remainder of the rod while the rod is anchored to the wall of the tunnel.

29. The apparatus according to claim 28 wherein the anchoring means for the rod include an anchoring device which is interengageable between the relatively tandemly projected portion of the rod and the wall of the tunnel.

30. The apparatus according to claim 29 wherein the anchoring means also include drive means for projecting the anchoring device into the tunnel from the casing at the distal end thereof.

31. The apparatus according to claim 30 wherein the drive means are operable to relatively advance the anchoring device into the tunnel contemporaneously with the rod.

32. The apparatus according to claim 30 wherein the drive means include the rod itself.

33. The apparatus according to claim 30 wherein the drive means include an elongated rod having the anchoring device on the distal end portion thereof.

34. The apparatus according to claim 29 wherein the anchoring device takes the form of a detent forming device which is mounted on the sides of the rod so as to be collapsible within the bore of the casing when the rod is relatively advanced telescopically through the length of the casing in the bore thereof, but then expansible relatively laterally outwardly of the rod to interengage between the relatively tandemly projected portion of the rod and the wall of the tunnel when the rod is relatively advanced into the tunnel from the casing at the distal end of the bore.

35. The apparatus according to claim 34 wherein the detent forming device includes a pair of detents which are reciprocably mounted on opposing sides of the rod so as to be retractable within the bore of the casing when the rod is relatively advanced telescopically through the length of the casing in the bore thereof, but yieldably biased to reciprocate into engagement with the wall of the tunnel when the rod is relatively advanced into the tunnel from the casing at the distal end of the bore.

36. The apparatus according to claim 35 wherein the distal end portion of the rod has a laterally outwardly opening recess therein, and the detents are reciprocably mounted on the distal end portion of the rod to be compressed against the bias thereon, relatively into the recess, by the wall of the bore in the casing, when the distal end portion of the rod is relatively advanced telescopically through the length of the casing in the bore thereof, but then released from the recess, laterally outwardly of the rod, for reciprocation into engagement with the wall of the tunnel, under the bias thereon, when the distal end portion of the rod is relatively advanced into the tunnel from the casing at the distal end of the bore.

37. The apparatus according to claim 30 wherein the rod is tubular, and the drive means include an extension thereof which has the anchoring device supported thereon and is mounted on the distal end of the rod to close the same to the earth formation.

38. The apparatus according to claim 28 further comprising an annular gland which is relatively telescopically interengageable between the rod and the wall of the bore to prevent liquid from flowing through the bore in the direction relatively toward the proximal end thereof when the rod is relatively advanced into the tunnel from the casing at the distal end of the bore.

39. The apparatus according to claim 38 wherein the gland is adapted to allow liquid to be passed through the bore in the direction relatively toward the distal end thereof, and the apparatus further comprises means for charging a pressurized liquid medium into the bore for discharge about the rod at the distal end of the bore when the rod is relatively advanced into the tunnel from the casing at the distal end of the bore.

40. The apparatus according to claim 28 further comprising a cap on the distal end portion of the casing which is operable to close the distal end of the bore to the earth formation, but removable from the distal end of the bore to open the same for the advance of the rod into the tunnel therethrough when the rod is relatively advanced into the tunnel from the casing at the distal end of the bore.

41. The apparatus according to claim 40 further comprising means for charging a pressurized fluid medium into the casing to remove the cap from the distal end of the bore when the rod is relatively advanced into the tunnel from the casing at the distal end of the bore.

42. The apparatus according to claim 40 wherein the cap is connected to the distal end portion of the casing so as to be removable from the casing by relatively endwise displacement thereof, the bore has a piston-like insert therein which is displaceable relatively endwise of the bore to displace the cap relatively endwise of the casing and then eject into the tunnel from the casing at the distal end of the bore, and the apparatus further comprises means for charging a pressurized fluid medium into the bore to displace the insert in the direction of the distal end of the bore and thereby remove the cap from the casing and eject the insert into the tunnel from the distal end of the bore to open the same for the advance of the rod into the tunnel therethrough.

43. The apparatus according to claim 42 wherein the cap is telescopically engaged about the distal end portion of the casing and fastened to the same by a shear pin, so that the cap can be unfastened from the casing for removal therefrom, by retracting the casing in the direction of the mouth of the tunnel while the pressurized fluid medium is applied to the insert to pressurize the same against the cap and thereby reciprocate the cap and the casing in relation to one another to shear the pin, the cap being removed from the casing thereafter by continued retraction of the casing in the direction of the mouth of the tunnel while the pressurized fluid medium is applied to the insert to eject the same from the distal end of the bore.

44. The apparatus according to claim 40 wherein the cap is equipped with a tunneling tool, and the casing installation means are operable to drive the casing into the earth formation behind the tool to excavate its own tunnel therein.

45. The apparatus according to claim 44 further comprising means for discharging a pressurized fluid medium from the cap during the tunnel excavating operation, to flush the excavated debris from the tunnel.

46. The apparatus according to claim 44 wherein the cap is ported and connected to the distal end portion of the casing so as to be removable from the casing by relative endwise displacement thereof, the bore has a piston-like insert therein which is displaceable relatively endwise of the bore to displace the cap relatively endwise of the casing and then eject into the tunnel from the casing at the distal end of the bore, the insert has an opening therein for passing a fluid medium therethrough between the bore and the port of the cap, the opening has a check valve therein which is disposed so that a pressurized fluid medium can be charged into the bore for discharge into the tunnel through the opening and the port of the cap to flush the excavated debris from the tunnel, but the valve will close to isolate the bore of the casing from the tunnel when the fluid discharge is discontinued, and wherein the apparatus further comprises means for charging a pressurized fluid medium into the bore during the tunnel excavating operation, to flush the excavated debris from the tunnel, a stopper for insertion in that entrance to the opening of the insert which lies adjacent the bore, to close the insert to the passage of fluid therethrough, and means for charging a pressurized fluid medium into the bore when the stopper is inserted in the entrance to the opening of the insert, to displace the insert in the direction of the distal end of the bore and thereby remove the cap from the casing and eject the insert into the tunnel from the distal end of the bore to open the same for the advance of the rod into the tunnel therethrough.

47. The apparatus according to claim 46 wherein the stopper is formed on the distal end of the rod for insertion in the entrance to the opening of the insert when the rod is telescopically advanced through the length of the casing in the bore thereof.

48. The apparatus according to claim 47 wherein the anchoring means for the rod include an anchoring device which is interengageable between the relatively tandemly projected portion of the rod and the wall of the tunnel, and drive means for projecting the anchoring device into the tunnel from the casing on the distal end portion of the rod.

49. The apparatus according to claim 46 wherein the cap takes the form of a ported, detachable bit which is diametrically oversized relative to the casing so that when the casing is employed as a drill rod and liquid swivel for the bit in the tunnel excavating operation, the tunnel will have a diameter which is adapted to provide an annulus around the casing through which the excavated debris can be flushed from the tunnel.

50. In apparatus for installing an elongated rod in an earth formation by installing an elongated tubular casing in a tunnel in the formation, relatively advancing the rod telescopically through the length of the casing in the longitudinally extending bore thereof, and then into the tunnel from the casing at the distal end of the bore, a device for anchoring the rod to the wall of the tunnel, comprising;

an elongated extension for the rod, securable at one end to the distal end of the rod, and detent forming means mounted on the sides of the extension so as to be collapsible within the bore of the casing when the extension is relatively advanced on the rod telescopically through the length of the casing in the bore thereof, but then expansible relatively laterally outwardly of the extension to interengage between the extension and the wall of the tunnel when the extension is relatively advanced into the tunnel from the casing at the distal end of the bore.

51. The apparatus according to claim 50 wherein the detent forming means include a pair of detents which are reciprocably mounted on opposing sides of the extension so as to be retractable in the bore of the casing when the extension is relatively advanced on the rod telescopically through the length of the casing in the bore thereof, but yieldably biased to reciprocate into engagement with the wall of the tunnel when the extension is relatively advanced into the tunnel from the casing at the distal end of the bore.

52. The apparatus according to claim 51 wherein the extension has a laterally outwardly opening recess therein, and the detents are reciprocably mounted on the extension to be compressed against the bias thereon, relatively into the recess, by the wall of the bore in the casing, when the extension is relatively advanced on the rod telescopically through the length of the casing in the bore thereof, but then released from the recess, laterally outwardly of the extension, for reciprocation into engagement with the wall of the tunnel, under the bias thereon, when the extension is relatively advanced into the tunnel from the casing at the distal end of the bore.

53. The apparatus according to claim 50 wherein the extension is adapted to close the distal end of a tubular rod.

54. The apparatus according to claim 50 wherein the extension has a stopper on the opposing end thereof, for insertion in the entrance to an opening in an insert in the bore of the casing.

55. An anchoring device for use on the distal end of an elongated rod when the rod is dismounted from an elongated tubular casing in a tunnel in an earth formation, comprising:

an elongated carrier device securable at one end to the distal end of the rod, means on the carrier device defining a laterally outwardly opening recess therein, a pair of elongated harpoon-like detents rotatably mounted on opposing sides of the carrier device so as to be retractable relatively into the recess when the carrier device is relatively advanced on the rod telescopically through the length of the casing in the longitudinally extending bore thereof, and means for yieldably biasing the detents to reciprocate laterally outwardly of the recess into engagement with the wall of the tunnel when the carrier device is relatively advanced into the tunnel from the casing at the distal end of the bore.

56. The anchoring device according to claim 55 wherein the carrier device has a stopper on the opposing end thereof for insertion in the entrance to an opening in an insert in the bore.

57. In apparatus for installing an elongated rod in an earth formation, an elongated tubular casing for installation in a tunnel in the earth formation, said casing having a longitudinally extending bore therethrough, a cap which is connected to the distal end portion of the casing so as to close the distal end of the bore, but is removable from the casing by relatively endwise displacement thereof, a piston-like insert in the bore which is displaceable relatively endwise thereof to displace the cap relatively endwise of the casing and then eject into the tunnel from the casing at the distal end of the bore, and means for charging a pressurized fluid medium into the bore to displace the insert in the direction of the distal end of the bore and thereby remove the cap from the casing and eject the insert into the tunnel from the distal end of the bore to open the same for the advance of the rod into the tunnel therethrough when the rod has been relatively advanced telescopically through the length of the casing in the bore thereof.

58. The apparatus according to claim 57 wherein the cap is telescopically engaged about the distal end portion of the casing and fastened to the same by a shear pin, so that the cap can be unfastened from the casing for removal therefrom, by retracting the casing in the direction of the mouth of the tunnel while the pressurized fluid medium is applied to the insert to pressurize the same against the cap and thereby reciprocate the cap and the casing in relation to one another to shear the pin, the cap being removed from the casing thereafter by continued retraction of the casing in the direction of the mouth of the tunnel while the pressurized fluid medium is applied to the insert to eject the same from the distal end of the bore.

59. The apparatus according to claim 57 wherein the cap is equipped with a tunneling tool so that the casing can be driven into the earth formation behind the tool to excavate its own tunnel therein.

60. The apparatus according to claim 59 further comprising means for discharging a pressurized fluid medium from the cap during the tunnel excavating operation, to flush the excavated debris from the tunnel.

61. The apparatus according to claim 59 wherein the cap is ported, the insert has an opening therein for passing a fluid medium therethrough between the bore and the port of the cap, the opening has a check valve therein which is disposed so that a pressurized fluid medium can be charged into the bore for discharge into the tunnel through the opening and the port of the cap to flush the excavated debris from the tunnel, but the valve will close to isolate the bore of the casing from the tunnel when the fluid discharge is discontinued, and wherein the apparatus further comprises means for charging a pressurized fluid medium into the bore during the tunnel excavating operation, to flush the excavated debris from the tunnel, a stopper for insertion in that entrance to the opening of the insert which lies adjacent the bore, to close the insert to the passage of fluid therethrough, and means for charging a pressurized fluid medium into the bore when the stopper is inserted in the entrance to the opening of the insert, to displace the insert in the direction of the distal end of the bore and thereby remove the cap from the casing and eject the insert into the tunnel from the distal end of the bore to open the same for the advance of the rod into the tunnel therethrough.

62. The apparatus according to claim 61 wherein the cap takes the form of a ported, detachable bit which is diametrically oversized relative to the casing, so that when the casing is employed as a drill rod and liquid swivel for the bit in the tunnel excavating operation, the tunnel will have a diameter which is adapted to provide an annulus around the casing through which the excavated debris can be flushed from the tunnel.

63. For use in apparatus for installing an elongated rod in an earth formation, a casing component comprising:

an elongated tubular casing for installation in a tunnel in the earth formation, said casing having a longitudinally extending bore therethrough, a cap which is connected to the distal end portion of the casing so as to close the distal end of the bore, but is removable from the casing by relatively endwise displacement thereof, and a piston-like insert in the bore which is displaceable relatively endwise thereof to displace the cap relatively endwise of the casing and then eject into the tunnel from the casing at the distal end of the bore, whereby a pressurized fluid medium can be charged into the bore to displace the insert in the direction of the distal end of the bore and thereby remove the cap from the casing and eject the insert into the tunnel from the distal end of the bore to open the same for the advance of the rod into the tunnel therethrough when the rod has been relatively advanced telescopically through the length of the casing in the bore thereof.

64. An elongated rod for dismounting from an elongated tubular casing in a tunnel in an earth formation, comprising:

elongated rod forming means defining the main body of the rod, an elongated extension on one end of the rod forming means, and detent forming means mounted on the sides of the extension so as to be collapsible within the longitudinally extending bore of the casing when the extension is relatively advanced on the rod forming means telescopically through the length of the casing in the bore thereof, but then expansible relatively laterally outwardly of the extension to interengage between the extension and the wall of the tunnel when the extension is relatively advanced into the tunnel from the casing at the distal end of the bore.

65. The elongated rod according to claim 64 wherein the main body of the rod is tubular and has apertures therein whereby the rod can function as a horizontal drain.

* * * * *